United States Patent [19]

Kadlic

[11] 4,377,285

[45] Mar. 22, 1983

[54] PLAYING CARD DISPENSER

[75] Inventor: Thomas P. Kadlic, Absecon, N.J.

[73] Assignee: Vingt-Et-Un Corporation, Absecon, N.J.

[21] Appl. No.: 285,478

[22] Filed: Jul. 21, 1981

[51] Int. Cl.[3] ..... A63F 1/10

[52] U.S. Cl. ..... 273/148 A; 211/51; 220/351

[58] Field of Search ..... 273/148 A, 149 R; 211/50, 51, 53; 220/345, 351

[56] References Cited

U.S. PATENT DOCUMENTS 963,760 7/1910 Hackett ..... 273/148 A UX
3,473,809 10/1969 Day ..... 273/148 A X

FOREIGN PATENT DOCUMENTS 710590 9/1941 Fed. Rep. of Germany ..... 220/351
530732 10/1921 France ..... 273/148 A

OTHER PUBLICATIONS

"Scarne's Encyclopedia of Games" by John Scarne, published by Harper & Row, N.Y., copyright 1973, p. 323.

*Primary Examiner*—Anton O. Oechsle
*Attorney, Agent, or Firm*—Seidel, Gonda, Goldhammer & Panitch

[57] ABSTRACT

A playing card dispenser comprising: (a) at least two compartments each appropriately sized to accommodate a stack of playing cards; (b) an exterior opening leading from each compartment and from which playing cards can be withdrawn one at a time; (c) a cover selectively placeable about any compartment from which playing cards are not to be withdrawn to block such withdrawal; and (d), as in a preferred embodiment, a roller mounted within a housing and disposed in each compartment behind each said stack, said roller gravitationally rollable on the floor of said compartment to maintain the stack of playing cards tightly stacked.

15 Claims, 4 Drawing Figures

PLAYING CARD DISPENSER

BACKGROUND OF THE INVENTION

This invention relates to a playing card dispenser comprising at least two separate compartments from which cards from separate stacks of cards there housed can be dealt.

Among the various games of chance which are played in gaming casinos worldwide is the game identified as "blackjack." In this game a player generally bets money or something of value, and is then dealt from a stack of one or more standard 52-card decks a number of playing cards whose individual point values are as follows: ace—one or eleven points, at the option of the player; king, queen and jack—ten points; and points equalling face value for the remainder of the cards. The cards are usually dealt from a card dispenser, commonly termed a "shoe," by a dealer who is employed by the casino. The game is begun with one or more shuffled full decks of cards making up a stack of cards which is disposed in the card dispenser. Usually, the entire stack of cards is played before the stack is replenished. The object of a player of the game is to be dealt cards which will come close to a total point value of 21, without exceeding 21, than will the point value of the cards dealt by the dealer to himself. If this object is accomplished, the player wins something of value. Conversely, if the object is not accomplished, the player loses his bet.

The type of game above-described is meant to be a game of chance, in that the player is not to know what the probable point value of his cards will be prior to his placing a bet. However, a mathematically astute player, commonly termed a "card counter," can, in fact, keep a statistically significant running total of cards already played from the stack of cards and thereby calculate the probable point value of subsequent cards to be dealt. Utilization of this knowledge removes the "chance" aspect of the game, and can result in an unfair advantage to the player.

As is evident, the apparatus employed in dealing the cards, the card dispenser or "shoe" above-described, is simply a dispenser, and has no accommodation whatsoever for varying in any way the manner in which cards are dispensed to thus reduce the opportunity presented for the "card counter." As is therefore apparent, a need is present for a card dispenser which can be regulateable to maintain the "chance" aspect of the game, yet not require a procedural departure from the normally-accepted manner of playing.

SUMMARY OF THE INVENTION

The subject of the instant invention is a playing card dispenser comprising:

a. at least two compartments each appropriately sized to accommodate a stack of playing cards;

b. an exterior opening leading from each compartment and from which playing cards can be withdrawn one at a time;

c. a cover selectively disposable about any compartment from which playing cards are not to be withdrawn to block such withdrawal; and d. means to maintain a stack of playing cards to be subsequently dealt tightly stacked within each respective compartment.

In a preferred embodiment the dispenser has two parallel and adjacent compartments. Each opening leading from each compartment is a slot and finger-grasp opening disposed at one end of each of said compartments. The cover is preferably slidably mounted on the dispenser for slidable movement from one compartment to the other. A most-preferred embodiment is that as described above wherein the floor of each compartment is angled downwardly toward the opening leading from each compartment and wherein means to maintain each stack of playing cards to be dealt tightly stacked comprises a roller mounted within a housing, and disposed in the compartment, said roller gravitationally rollable on the floor of the compartment and having a housing whose forward wall to be adjacent a stack of cards to be dealt is angled rearwardly from about 50 degrees to about 70 degrees, and whose rear wall to be adjacent a stack of discarded cards already dealt is angled forwardly from about 50 degrees to about 70 degrees.

Also provided is an improvement in a game of chance utilizing playing cards dealt from a single stack of playing cards and having pre-determined point values wherein the objective of a player of said game is to be dealt playing cards which will come closer to a predetermined number of points than the number of points a dealer of said playing cards obtains, but without exceeding said pre-determined number of points, and wherein the player bets something of value that said objective will be accomplished, wherein the improvement comprises utilization of at least two separate stacks of playing cards from which a dealer can deal and wherein the player bets prior to the determination of the stack from which cards will be dealt, with the determination of said stack from which cards will be dealt then determined by chance, and further wherein said stacks of cards are housed in an embodiment of a playing card dispenser as above disclosed.

While the inventive subject matter is related to the game of blackjack, it is, of course, evident, and to be understood, that point values of playing cards, predetermined values to be obtained, and the like, can be varied from those values in the game of blackjack without departing from the inventive aspects here related.

DETAILED DESCRIPTION OF A PREFERRED EMBODIMENT

Figure 1:
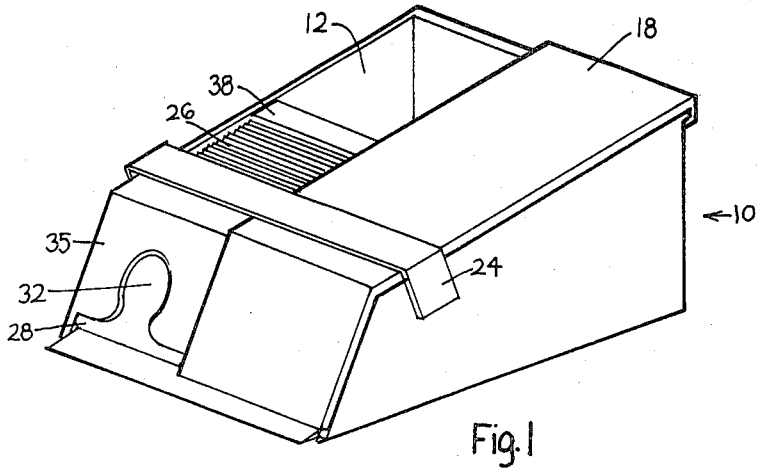
FIG. 1 is a perspective view of a card dispenser having two compartments and a cover selectively placeable about one compartment.
Figure 2:
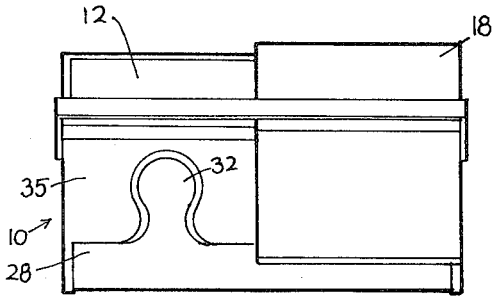
FIG. 2 is a front elevational view of the dispenser of FIG. 1.
Figure 3:
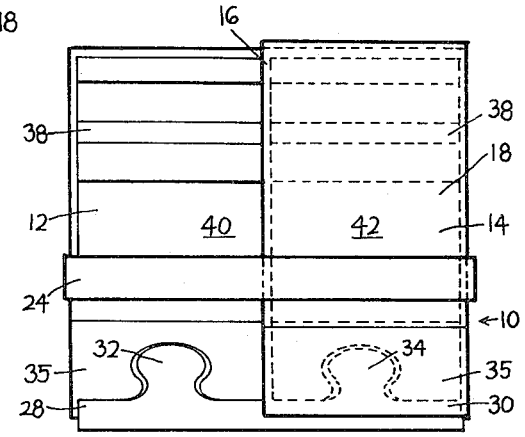
FIG. 3 is a top plan view of the dispenser of FIG. 1, showing in phantom lines one compartment.
Figure 4:
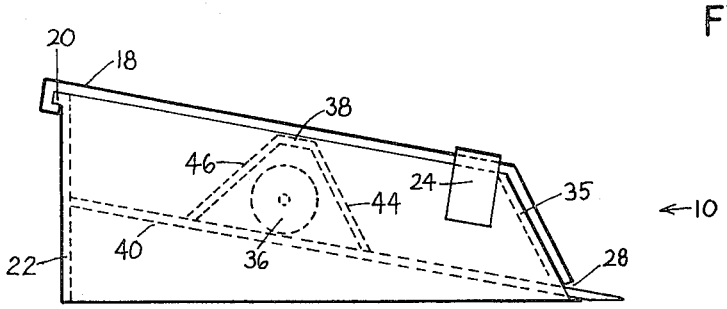
FIG. 4 is a side elevational view of the dispenser of FIG. 1, showing in phantom lines the floor, interior wall, and roller means of said dispenser.

Referring to FIGS. 1–4, a playing card dispenser 10 is shown. The dispenser 10 has two compartments 12, 14 separated by a common wall 16. A cover 18 sized to be the width of each compartment 12, 14 is slidably mounted on a lip 20 projecting from the rear wall 22 of the dispenser 10. An optional rigid retainer 24 mounted to the side walls of the dispenser 10 and disposed transversely across the top of said dispenser 10 prevents removal of the cover 18. As is evident from the drawings, the cover 18, shown in position over compartment 14, prohibits withdrawal of any cards therein so long as said cover is so positioned. For illustration purposes, a stack 26 of playing cards is shown in compartment 12 of FIG. 1. Respective exterior openings leading from each compartment 12, 14 consist of, respectively, slots 28, 30 and, respectively, finger-grasp openings 32, 34 in a front plate 35. Means to maintain a stack 26 of playing cards, to be subsequently dealt, tightly stacked within a compartment 12, for example, comprises a roller 36, shown in FIG. 4, mounted rotatably within a housing 38. The floors 40, 42 of each compartment 12, 14 are angled downwardly toward each slot 28, 30, so that the roller 36 is gravitationally rollable on said floors 40, 42. The forward wall 44 of the housing 38 is angled rearwardly, as measured from a base line, from about 50 degrees to about 70 degrees, while the rear wall 46 of said housing 38 is angled forwardly, as measured from a base line, from about 50 degrees to about 70 degrees. Angling of the forward wall 44 is as known in the art. Angling of the rear wall 46 permits, as desired, convenient placement behind said wall 46 of cards already played.

The material utilized in constructing the dispenser 10 is preferably a rigid plastic procedurally assembled as generally known in the art, but, of course, can be of any material which will achieve the utility characteristics of said dispenser.

In operation, a dealer places one or more decks of cards in each compartment 12, 14 between the front plate 35 and the forward wall 44 of the housing 38 so that the resultant stacks of cards are tightly stacked therein. The cards can then be removed and dealt one at a time through the slots 28, 30 utilizing the finger-grasp openings 32, 34. Usually, of course, said decks of cards are shuffled before such placement. After so doing, multiple games of chance can be played, as desired, until the entire stacks of cards are dealt. The general games of chance contemplated for playing are those as broadly described in the Summary of the Invention section appearing above. As an illustration of such general games, the specific game of blackjack, as earlier described, will now be related to the use of the dispenser 10.

In a game of blackjack wherein the dispenser 10 is employed, a player places his bet prior to the dealing of any cards. After said bet is placed, a determination by chance is made to discover from which compartment, 12 or 14, cards will be dealt. The determination by chance is preferably made by drawing one card from either compartment 12 or 14. If the card is red (a heart or a diamond), one compartment (e.g. compartment 12) will be used and compartment 14 will be covered to prevent accidental drawing therefrom. If the card is black (a spade or a club), the other compartment (e.g. compartment 14) will be used and compartment 12 will be covered. Of course, other chance determiners, such as flipping a coin, for example, can be used in determining the compartment from which cards will be dealt. Subsequent to the completion of the first game, the above sequence of betting and compartment determination is again performed as often as possible until one stack is totally consumed. As is evident, a player does not know the compartment, 12 or 14, from which cards will be dealt until after his bet is placed. As a result, utilization of the dispenser 10 greatly reduces the advantage of card counting since, unless all stacks coincidentally become rich in favorable cards at the same time ( a very low probability), the player has no way of foretelling prior to betting which stack will be employed and therefore will not know if a favorable stack will be chosen. Of course, as the number of compartments within a dispenser increases as, for example, to three, four, or more compartments, the probability of all stacks coincidentally becoming rich in favorable cards at the same time continues to decrease. Thus, such games of chance again regain the attribute of "chance."

It is to be understood that the above description and embodiment are illustrative and not limiting, and that the intended scope of the invention is now defined in the claims which follow.

What is claimed is:

1. In a game of chance utilizing playing cards having pre-determined point values wherein the objective of a player of the game is to be dealt cards which will come closer to a predetermined number of points than the number of points a dealer of the cards obtains, but without exceeding the pre-determined number of points, and wherein the player bets something of value that the objective will be accomplished, the improvement comprising the method of:

(a) utilizing at least two separate stacks of cards from which the dealer can draw;
(b) betting prior to selecting from which stack the cards will be drawn;
(c) selecting, by chance, one of the stacks from which the cards will be drawn;
(d) drawing the cards from the selected stack; and
(e) dealing the cards drawn from the selected stack to the player.

2. The method according to claim 1 wherein two separate stacks of cards are utilized.

3. The method according to claim 1 further comprising assigning a color designating each stack corresponding to a card color and determining from which stack the cards will be drawn by drawing a single card from one stack, with the color of the card designating the stack from which the cards will be drawn.

4. The method according to claim 1, further comprising placing the stacks in means for containing the stacks and drawing cards from the stacks placed therein.

5. The method according to claim 4 wherein the means for containing the stacks comprises at least two compartments each appropriately sized to accomodate a stack of playing cards, an exterior opening leading from each compartment from which playing cards can be withdrawn one at a time, a cover selectively placeable about any compartment from which playing cards are not to be withdrawn to block such withdrawal, and means to maintain each of the stacks of playing cards stacked within each respective compartment.

6. The method according to claim 5 wherein the means for containing the stacks has two compartments, one for each stack, the cover being mounted for sliding movement.

7. A playing card dispenser comprising:

(a) at least two compartments each appropriately sized to accomodate a stack of the cards, each compartment having a floor and front, back, and side walls but being open at the top, the floor being angled downwardly toward the front wall;
(b) an opening in the front wall of each compartment from which the cards can be withdrawn one at a time;
(c) a cover shaped to overlie the front wall and top of all compartments except one from which the cards are to be withdrawn; and
(d) a roller assembly within each compartment, the assembly comprising a roller mounted within a housing moveable within each stack, the roller being rollable on the floor, the housing having a front face angled downwardly toward the front and a rear face angled downwardly toward the rear, whereby cards can be stacked against both faces of the housing.

8. A playing card dispenser as claimed in claim 7 having two compartments.

9. A playing card dispenser as claimed in claim 8 wherein the compartments are parallel and adjacent each other, and each opening is a slot and finger-grasp opening in the front wall of each compartment.

10. A playing card dispenser as claimed in claim 8 wherein the cover is slidably mounted thereon for slidable movement from one compartment to the other.

11. A playing card dispenser as claimed in claim 7 wherein each compartment is marked with indicia associated with means for determining from which compartment the cards will be withdrawn.

12. A playing card dispenser as claimed in claim 11 having two compartments, one compartment having red indicia, the other compartment having black indicia, and the means for determining from which compartment the cards will be withdrawn being a card withdrawn from a compartment, a red card indicating the cards are to be withdrawn from the one compartment having the red indicia, a black card indicating the cards are to be withdrawn from the other compartment having the black indicia.

13. A playing card dispenser comprising:

(a) at least two compartments each appropriately sized to accomodate a stack of the cards;

(b) an exterior opening leading from each compartment from which the cards can be withdrawn one at a time;

(c) a cover selectively placeable about any compartment from which the cards are not to be withdrawn to block such withdrawal; and (d) means to maintain each stack of cards tightly stacked within each respective compartment, wherein each compartment has a floor angled downwardly toward the opening leading from each compartment and wherein the means to maintain each stack of playing cards stacked comprises a roller mounted within a housing disposed in each compartment behind each of the stacks, the roller gravitationally rollable on the floor of the compartment, the housing having a forward wall adjacent a stack of playing cards to be withdrawn and angled rearwardly from about 50 degrees to about 70 degrees and a rearward wall adjacent a stack of discarded playing cards previously withdrawn and angled forwardly from about 50 degrees to about 70 degrees.

14. A playing card dispenser comprising:

(a) two compartments each appropriately sized to accommodate a stack of the cards, the compartments being parallel and adjacent each other;

(b) an exterior opening leading from each compartment from which the cards can be withdrawn one at a time, each opening being a slot and finger-grasp opening disposed at one end of each compartment;

(c) a cover selectively placeable about any compartment from which the cards are not to be withdrawn to block such withdrawal; and (d) means to maintain each stack of playing cards tightly stacked within each respective compartment, wherein each compartment has a floor angled downwardly toward the opening leading from each compartment and where the means to maintain each stack of playing cards stacked consists of a single roller mounted within a housing disposed in each compartment behind each of the stacks, the roller being gravitationally rollable on the floor of the compartment.

15. A playing card dispenser as claimed in claim 14 wherein the cover is slidably mounted on the dispenser.

* * * * *